United States Patent [19]

Cabanos et al.

[11] Patent Number: 4,867,419

[45] Date of Patent: Sep. 19, 1989

[54] DEFLECTABLE TRUNNION ASSEMBLY

[75] Inventors: Phil A. Cabanos, Santa Clara; Gordon E. Rado, Palo Alto, both of Calif.

[73] Assignee: United States of America, Washington, D.C.

[21] Appl. No.: 330,951

[22] Filed: Mar. 23, 1989

Related U.S. Application Data

[63] Continuation of Ser. No. 214,885, Jun. 30, 1988, abandoned, which is a continuation of Ser. No. 88,434, Aug. 24, 1987, abandoned.

[51] Int. Cl.[4] ..... B66D 3/08

[52] U.S. Cl. ..... 254/399; 254/415

[58] Field of Search ..... 254/285, 326, 337, 390, 254/393, 399, 401, 402, 403, 404, 409, 415; 384/2, 203, 206, 606, 619, 620, 622

[56] References Cited

U.S. PATENT DOCUMENTS

| | | | |
|---|---|---|---|
| 131,594 | 9/1872 | Boyle | 254/401 |
| 381,043 | 4/1888 | Vauclain | 254/415 X |
| 1,214,745 | 2/1917 | Beard et al. | 212/158 X |
| 2,032,764 | 3/1936 | Otte | 254/415 X |
| 3,250,516 | 5/1966 | Silberger | 254/409 |
| 3,508,667 | 4/1970 | Commora | 254/409 X |
| 4,166,659 | 9/1979 | Gleichman | 384/620 |

FOREIGN PATENT DOCUMENTS

| | | | |
|---|---|---|---|
| 25928 | 10/1969 | Japan | 254/393 |

*Primary Examiner*—Joseph J. Hail, III

*Attorney, Agent, or Firm*—Robert M. Wohlfarth; John P. Tarlano

[57] ABSTRACT

A deflectable trunnion assembly that has a deflectable eye member or hook. The trunnion assembly is connectable to a pulley block of a hoist. The trunnion assembly has a trunnion block on which a deflectable spherical roller thrust bearing rides. The eye member rides on the spherical roller thrust bearing. The trunnion block is covered by a cover that contains a dome. The eye member ends in a pin that has a balled end. The balled end of the pin rotates within the dome, during deflection within the spherical roller thrust bearing of the trunnion assembly.

2 Claims, 2 Drawing Sheets

DEFLECTABLE TRUNNION ASSEMBLY

This is a continuation of application Ser. No. 214,885 filed on June 30, 1988, now abandoned, which was a continuation of application Ser. No. 088,434 filed Aug. 24, 1987, also now abandoned.

BACKGROUND OF THE INVENTION

The present invention relates to a deflectable trunnion assembly that has a deflectable eye. The trunnion assembly is attached to a pulley block of a hoist.

In the prior art, non-deflectable trunnion assemblies are shown. Such assemblies have bearing assemblies which will allow for rotation of an eye member or hook of the trunnion assembly. However, such trunnion assemblies are not designed to allow for deflection of the eye member or hook of the trunnion assembly, away from the longitudinal axis of the trunnion assembly.

One such non-deflectable trunnion assembly is shown in the U.S. Pat. No. 1,214,745. The hook is rotatable within the trunnion assembly. However, provision has not been made in the trunnion assembly for the hook to be deflectable away from the longitudinal axis of the assembly.

U.S. Pat. No. 131,594 shows an eye member connected to a ball. The ball moves in a socket formed in an extension of a pulley block. However, the patent does not show or suggest a trunnion assembly that has a deflectable and rotatable bearing assembly in a trunnion block for holding a load.

The disclosed deflectable trunnion assembly of the present invention will allow for easy rotation and deflection even though when the trunnion assembly is subjected to heavy loads, since it has a deflectable and rotable bearing assembly therein.

SUMMARY OF THE INVENTION

The present invention relates to a deflectable trunnion assembly. The assembly has a bearing assembly that rides in a trunnion block around an opening in the trunnion block. A nut is supported by the bearing assembly and is connected to an eye. The eye passes through the opening. The trunnion assembly will accomodate deflections of the eye away from the longitudinal axis of the trunnion assembly. Such deflections may be used in connecting the eye of the trunnion assembly to a load.

The invention also relates to the use of the trunnion assembly with a pulley block. The center of gravity of the trunnion assembly is connected near the axis of rotation of the trunnion assembly with respect to the pulley block.

An object of the invention is to provide a trunnion assembly which has an eye or hook that will rotate easily and yet be capable of deflections away from the longitudinal axis of the trunnion assembly.

DESCRIPTION OF THE PREFERRED EMBODIMENT

Having described the present invention above, a preferred embodiment is described below.

Figure 1:
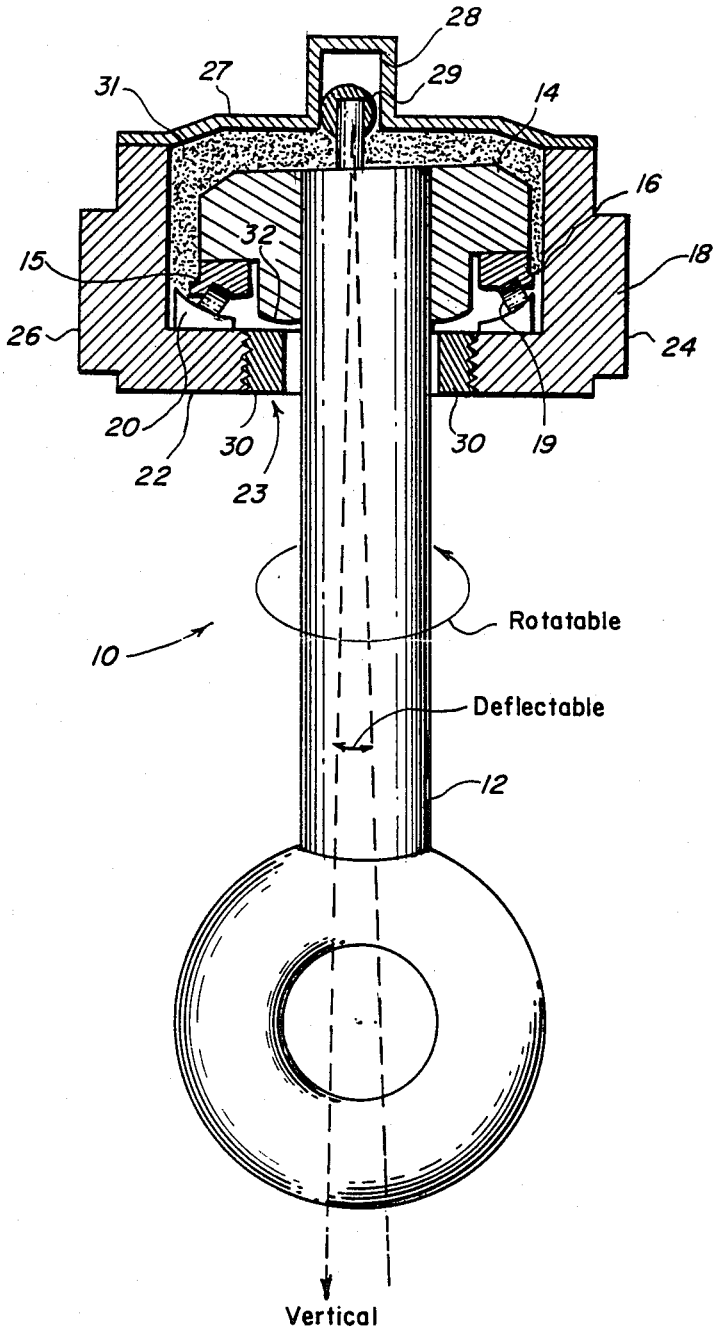
FIG. 1 is a plan view of a deflectable trunnion assembly.

FIG. 1 shows deflectable trunnion assembly 10. The trunnion assembly 10 has an eye member 12. The eye member 12 is attached to a nut 14. The nut 14 rides on an upper race or shaft washer 15 of a deflectable bearing assembly 18. Spherical roller thrust bearings 19 are housed in a cage 16 which is attached to the shaft washer 15.

In the preferred embodiment, the bearing 18 is a spherical roller thrust bearing assembly. SKF Industries, Inc. of King Of Prussia Pa. makes such bearing assemblies. However, the invention is not limited to any particular type of bearing assembly but contemplates any bearing assembly which will ride in a trunnion block and will allow for deflections and rotations of an eye member or a hook member.

The lower race or housing washer 20 of bearing assembly 18 rides in a trunnion block 22 around an opening 23. The eye member 12 passes through opening 23. The trunnion block 22 has trunnions 24 and 26 formed thereon. A cover plate 27 is attached to the top of trunnion block 22. The cover plate 27 is used to prevent the eye 12 and nut 14 from moving too far upward and out of the trunnion block 22. The cover plate 27 has a dome 28 that allows a rounded pin 29 in the eye member 12, to move vertically upward a small distance and laterally a small distance. By this constraint, the pin 29 becomes the pivot point of the eye 12.

A ring 30 is used to hold grease 31 in the trunnion block 22. The ring 30 is threaded into the lower side of the trunnion block 22. The ring 30 will prevent most grease, placed inside the trunnion block 22 in order to lubricate both the bearing assembly 18 and its adjacent trunnion surfaces, from escaping from the interior of the trunnion block 22, even though the eye 12 is deflected. The ring 30 extends near to the eye member 12. The ring also extends near to beveled area 32 of nut 14 to prevent grease from escaping from trunnion block 22.

The trunnions 24 and 26 are positioned on the trunnion block 22 so that the weight of the portion of the eye 12 below the trunnion block 22 is center balanced by the weight of the rest of the trunnion block assembly 10. The trunnions 24 and 26 are thus located substantially at the longitudinal center of gravity of trunnion assembly 10.

Figure 2:
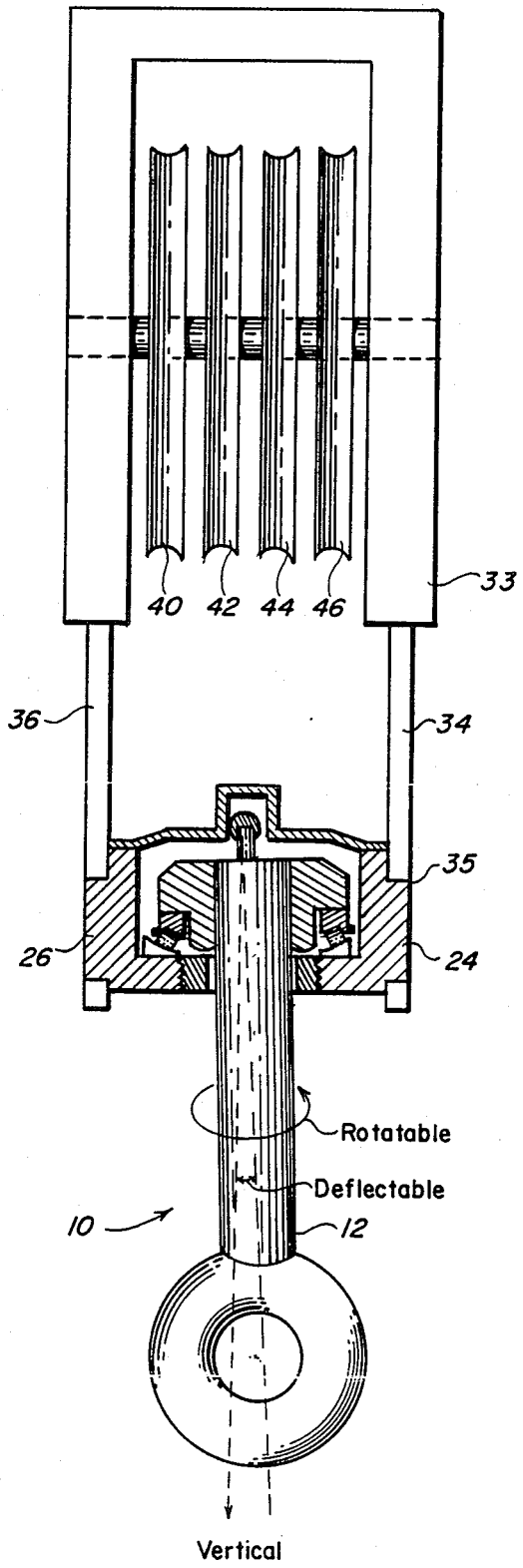
FIG. 2 is a plan view of a combination of a pulley block and deflectable trunnion assembly.

FIG. 2 shows a pulley block 33 connected to trunnion assembly 10. An arm 34 of the pulley block 33 is connected to the trunnion 24. A hole 35 in the arm will so accommodate the trunnion 24. Similarly, an arm 36 of pulley block 33 is connected to trunnion 26. The pulley block 33 has pulleys 40, 42, 44 and 46 therein. These pulleys accommodate a hoist cable which is looped through the pulley block 33, to raise or lower the pulley block 33 and trunnion assembly 10. The hoist cable may be used to raise and lower a load which is attached to the eye member 12. Such attachment of the load to the eye member 12, may be by means of a hook or other suitable means.

The eye member 12 may be deflected, as shown in FIG. 1, in order to be moved more easily into alignment with a load, such as a load which is not directly aligned with the eye member 12. The trunnion assembly 10 will also allow for rotation of the eye member 12 in a complete circle, to allow the eye member 12 to be more easily connected to a load. By means of such rotation the plane of the eye member 12 will pass through the load.

While the present invention has been disclosed in connection with the preferred embodiment thereof, it should be understood that there may be other embodiments which fall within the spirit and scope of the invention as defined by the following claims.

What is claimed is:

1. A deflectable trunnion assembly, comprising:

(a) a trunnion block having an opening;

(b) a deflectable and rotatable spherical roller thrust bearing assembly whose upper race and bearings pivot in an arcuate manner relative to a lower race during deflection, and having a cage that houses the bearings, whose first side rides on the trunnion block around said opening, the trunnion block keeping the lower race from pivoting;

(c) a nut riding on, and mounted for movement with, a second side of the deflectable and rotatable bearing assembly;

(d) a cylindrical eye member attached to the nut and passing through said opening, the eye member ending in a rounded pin that has a smaller diameter than the eye member; and (e) a cover plate attached to the trunnion block above the deflectable and rotatable trunnion assembly, the cover plate having a dome that has a diameter that is larger than the pin but smaller than the eye member, the dome housing the pin, the dome acting as a pivot point as the upper race and bearings pivot in an arcuate manner relative to the lower race.

2. A pulley block and deflectable trunnion assembly combination comprising:

(a) a pulley block;

(b) arms attached to sides of the pulley block, the arms extending away from the pulley block;

(c) a trunnion block having two trunnions on its opposite sides, each trunnion rotatably attached to a free end of an arm, the trunnion block also having an opening on a side that is opposite the pulley block;

(d) a deflectable and rotatably spherical roller thrust bearing assembly whose upper race and bearings pivot in an arcuate manner relative to a lower race during deflection and having a cage that houses the bearings, whose first side rides on a substantially central portion of the trunnion block and around said opening, the trunnion block keeping the lower race from pivoting;

(e) a nut riding on, and mounted for movement with, a second side of the deflectable and rotatable bearing assembly;

(f) a cylindrical member attached to a substantially central portion of the nut, and passing through the opening in the trunnion block, the eye member ending in a rounded pin that has a smaller diameter than the eye member; and (g) a cover plate attached to the trunnion block above the deflectable and rotatable trunnion assembly, the cover plate having a dome that has a diameter that is larger than the pin but smaller than the eye member, the dome housing the pin, the dome acting as a pivot point as the upper race and bearings pivot in an arcuate manner relative to the lower race.

* * * * *